US006391081B1

(12) United States Patent
Uchikoshi et al.

(10) Patent No.: US 6,391,081 B1
(45) Date of Patent: May 21, 2002

(54) METAL PURIFICATION METHOD AND METAL REFINEMENT METHOD

(75) Inventors: Masahito Uchikoshi; Norio Yokoyama; Minoru Isshiki; Kouji Mimura, all of Miyagi (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/533,537

(22) Filed: Mar. 23, 2000

(30) Foreign Application Priority Data

Mar. 25, 1999 (JP) ..... 11-082237

(51) Int. Cl.[7] ..... C22B 9/05; C22B 9/10

(52) U.S. Cl. ..... 75/10.19; 75/10.22; 75/10.66; 75/10.65

(58) Field of Search ..... 75/10.19, 10.22, 75/10.65, 10.66

(56) References Cited

U.S. PATENT DOCUMENTS 3,429,691 A * 2/1969 McLaughlin ..... 75/10.19
3,547,622 A * 12/1970 Hutchinson ..... 75/10.19
3,940,551 A * 2/1976 Ling et al. ..... 75/10.66
4,376,740 A * 3/1983 Uda et al. ..... 75/336
5,562,809 A * 10/1996 Sorokin ..... 204/164

FOREIGN PATENT DOCUMENTS

JP 56023239 A * 3/1981
JP 61052307 A * 3/1986
JP 2000017345 A * 1/2000

OTHER PUBLICATIONS

Derwent Acc No. 1981–29871D abstract of JP 56023239 A published Mar. 5, 1981 and JP 84030777 B published Jul. 28, 1984.*

Derwent Acc No. 2000–156987 abstract of JP 2000017345 A published Jan. 18, 2000.*

* cited by examiner

*Primary Examiner*—Roy King
*Assistant Examiner*—Tima McGuthry-Banks
(74) *Attorney, Agent, or Firm*—Bell, Boyd & Lloyd LLC

(57) ABSTRACT

A metal purification method and a metal refinement method in which metals of high purity can be easily refined and recovered without increasing the size of the purification and refining devices or complicating the operation. To this end, metals containing impurities are molten in a plasma arc containing active hydrogen to remove the impurities. If the metals contain ceramics inclusions, the metals are molten in a plasma arc containing active hydrogen and the ceramics inclusions are caused to float over the molten metal by exploiting the difference of density between the molten metal and the ceramics inclusions. The floating ceramics inclusions are decomposed and removed. For application to refining, the metal oxides are molten in a plasma arc containing active hydrogen so as to be reduced to metals.

12 Claims, 3 Drawing Sheets

CHANGES IN CONCENTRATION OF NITROGEN IN Fe

METAL PURIFICATION METHOD AND METAL REFINEMENT METHOD

FIELD OF THE INVENTION

This invention relates to a method for purifying industrially critical metals, such as Fe, Co, Ni or Cu to metal of high purity by removing minor amounts of impurities contained in those metals, such as light elements, alkali metals, alkali earth metals or ceramics. The present invention also relates to a method for refining the metals.

BACKGROUND OF THE INVENTION

Metals such as Fe, Co, Ni or Cu are used as materials of electronics or as functional materials extensively. In particular, Fe and,Co are used for a variety of recording mediums exploiting characteristics as a ferromagnetic material, a permanent magnet material or as a positive electrode material for lithium ion cells.

An evaporated tape for recording digital signals, a photomagnetic optical recording medium exemplified by MO or MD and a magnetic recording medium exemplified by a hard disc are enumerated as recording medium. As the permanent magnet material, SmCo or NdFeB is noteworthy. As a matter of course, these materials are desirable of high purity.

From now on, it is quite within the bounds of possibility that metals such as Fe, Co, Ni or Cu will be used as starting material for LSI. In these years, investigation of sputtering of these metals are going on briskly. For example, if Co is used as an electrode material, the demand for a $CoSi_x$ (where x>O) target is increased, such that high purity Co becomes more and more crucial for industrial application. Also, Fe, which is expected as a material of semiconductor working in infrared range will become more critical in time to come.

Thus, metals used for semiconductors, such as Fe, Co, Ni or Cu are required to be higher in purity than the materials used for the above recording mediums. For example, there is raised a strong demand for reducing the content of alkali metal impurities deteriorating characteristics of MOS devices, such as Na, alkaline earth metal impurities, such as Mg or Ca, or of radioactive impurity elements radiating $\alpha$-rays to give rise to malfunctions, such as U or Th.

Under the above-described technical background, the demand for high-purity Fe, Co, Ni or Cu is considered to be increasing in time to come.

So, prompt and efficient removal of oxygen is imperative for regenerating and improving the purity of these metals. This removal of the large quantity of oxygen is equivalent in principle to routine metal refining of removing oxygen from metal oxides to yield metal. However, there is not known up to now a technique of effectively recycling these used Fe, Co, Ni or Cu from the viewpoint of economy and maintenance of earth environment.

Thus, in these years, a technique of refining raw metals or used Fe, Co, Ni or Cu metal to high purity, in particular a technique which is easy to work out, economically meritorious and more amicable to environment, has been desired.

Heretofore, the prevalent way to reduce metal oxides takes much time, such as (i) a method of reducing the metal oxides by dry refining, using reducing agents, such as C, Al or Mg;

(ii) a method of transiently dissolving metal oxides in an aqueous solution for recovering metals on electrolysis; or (iii) a method of elevating the temperature in a reducing atmosphere, such as in a hydrogen stream, for reducing the metal oxides.

In the method (i) above, Al or Ca, exhibiting higher affinity to oxygen than the metals, is molten as reducing agents along with metal and removed from the metals as $Al_2O_3$ or CaO.

If, in this case, the amount of oxygen contained in the metal is not estimated elaborately in advance, there are raised such problems that the oxygen cannot be removed sufficiently depending on the charged amount of the reducing agent or that conversely the excess reducing agent, such as Al or Ca, be left over as impurities.

In the method (ii) above, $H_2$ or $Cl_2$ gases are inevitably generated as reaction products if a HCI Bath is used as a solvent. The method shown in (iii) above has a drawback that the reaction temperature is extremely high such that a high energy is required.

In addition to the aforementioned oxygen removing method, the following process is known as a method for removing metal and non-metal impurities.

The alternative method is to melt an impure metal with electron beam in vacuum of $10^{-2}$ to $10^{-4}$ Pa, where the impurities will be evaporated and removed because of the difference of vapor pressure between the impurities and matrix metals. The problem encountered in this method is that an evacuating device of large displacement is needed and that the vacuum needs to be maintained for prolonged time thus increasing the size of the device. Moreover, if the amount of metal impurities is to be reduced to a smallest amount possible, prolonged melting is mandatory, with the result that the loss of metals due to evaporation is increased, thus lowering the yield.

Moreover, with the above-described technique, radioactive element impurities, such as U or Th, are difficult to remove. If desired to remove these radioactive element impurities, such as U or Th, the metals need to be dissolved in aqueous solutions and wet processes, such as ion exchange methods or solvent extraction methods, need to be executed. These wet processes are uneconomical since the required space is tens to hundreds times of the unit processing volume as compared to the dry process exemplified by the melting method. The method of recovering metals from the metal-containing solution, purified by the wet process, such as the electrolysis or the method of evaporating the solution to dryness to recover metal salts and processing the metal salts to solid-phase hydrogen reduction, is also extremely time and energy consuming, and hence uneconomical.

SUMMARY OF THE INVENTION

It is therefore an object of the present invention to provide a complete recycling process in which high-purity metals, such as Fe, Co, Ni or Cu, can be easily purified and recovered without excessively increasing the size of the purification and refining device or its ancillary devices or excessively complicating the operation.

The present inventors have conducted prolonged and perseverant investigations towards resolving the above-mentioned technical problems, and found that, by melting metals, such as Fe, Co, Ni or Cu with the hydrogen plasma arc melting method or the hydrogen atmosphere arc melting method, trace amounts of alkali metal impurities, such as Na, alkaline earth metal impurities, such as Ca, non-metal impurities, such as oxygen, nitrogen or carbon, or radioactive element impurities, such as U or Th, contained in metals, such as Fe, Co, Ni or Cu, can be promptly removed on vaporization by the sole melting process. This information has led to completion of the present invention.

The present inventors have also elaborated the information that oxygen in metal can be removed by the hydrogen plasma arc melting method or the hydrogen atmosphere arc melting method, and found that these methods can be applied to the method of refining high-purity oxides of Fe, Co, Ni or Cu to high-purity Fe, Co, Ni or Cu metals. This finding also has led to completion of the present invention.

In one aspect, the present invention provides a method for purifying metals, wherein metals containing impurities are molten by an argon-hydrogen plasma arc containing active hydrogen H to remove the impurities.

In another aspect, the present invention provides a method for refining metals wherein metals including ceramics inclusions are molten by an argon-hydrogen plasma arc containing active hydrogen H, wherein the ceramics inclusions are floated over molten metal because of difference of density between the molten metal and the ceramics inclusions, and wherein the floating ceramics inclusions are decomposed and removed.

In yet another aspect, the present invention provides a method for refining metals wherein metal oxides are molten by an argon-hydrogen plasma arc containing active hydrogen H for reducing the metal oxides to metals.

The basic concept underlying the above-mentioned respective aspects of the present invention is the use of the hydrogen plasma arc melting method or the hydrogen atmosphere arc melting method for refining metals, such as Fe, Co, Ni or Cu. This effectively removes non-metallic impurities, such as oxygen, nitrogen or carbon to enable refining and recovery of high-purity metals containing these impurities at an extremely low level.

The refining process defined above is clean and amenable to earth environment since the time of reducing reaction per unit volume is extremely short and no reaction products other than the metals and $H_2O$ (+Ar) are yielded.

Similarly, with the refining method according to the present invention, there may be provided a process for reducing metal oxides which is clean and devoid of by-produced CO or $CO_2$ in comparison with the conventional technique. The refining process according to the present invention is not only economical but also amenable to environment.

Thus, according to the present invention, there may be provided a purification and refining methods whereby high-purity metals (Fe, Co, Ni and Cu) can easily be purified and recovered, with the possibility of complete recycling inclusive of regeneration and re-utilization thereof, without excessively increasing the size of the purification and refining device or its ancillary devices or excessively complicating the operation.

In a first embodiment, the present invention provides a method for purifying metals that comprises melting at least one metal containing at least one impurity in an argon-hydrogen plasma arc further comprising active hydrogen H to remove said impurities.

In the first embodiment, said metal comprises at least one metal selected from the group consisting of Fe, Co, Ni and Cu.

In the first embodiment, said plasma arc contains argon as a generating gas.

In the first embodiment, said impurities comprise at least one selected from the group consisting of alkali metal impurities, alkaline earth metal impurities, non-metallic impurities and radioactive element impurities.

In the first embodiment, the non-metallic impurities comprise at least one impurity selected from the group consisting of oxygen, nitrogen and carbon.

In the first embodiment, the hydrogen in the plasma arc generating gas is present in an amount ranging from about 0.05 vol % to about 100 vol %.

In the first embodiment, the melting step is conducted in a furnace having a pressure ranging from about 1.33 kPa to about 310 kPa.

In a second embodiment, the present invention provides a method for refining metals that comprises melting at least one metal comprising at least one ceramic in an argon-hydrogen plasma arc further comprising active hydrogen H; floating said ceramic over molten metal by utilizing differences in density between the molten metal and the ceramic; and decomposing and removing the floating ceramic.

In the second embodiment, said metal comprises at least one metal selected from the group consisting of Fe, Co, Ni and Cu.

In the second embodiment, the hydrogen is present in the plasma arc generating gas in an amount ranging from about 0.05 vol % to about 100 vol %.

In the second embodiment, the melting, floating and decomposing and removing steps are carried out in a furnace having a pressure ranging from about 1.33 kPa to about 310 kPa.

In a third embodiment, the present invention provides a method for refining metals that comprises melting at least one metal oxide in an argon-hydrogen plasma arc further comprising active hydrogen H for reducing the at least one metal oxide to a metal.

In the third embodiment, said metal comprises at least one metal selected from the group consisting of Fe, Co, Ni and Cu.

In the third embodiment, the hydrogen is present in the plasma arc generating gas in an amount ranging from about 0.05 vol % to about 100 vol %.

In the third embodiment, the melting step is carried out in a furnace having a pressure ranging from about 1.33 kPa to about 310 kPa.

Other objects and advantages of the present invention will become apparent upon reading the following detailed description and appended claims, and upon reference to the accompanying drawings.

BRIEF DESCRIPTION OF THE DRAWINGS

For a more complete understanding of the present invention, reference should now 20 be made to the detailed description of the presently preferred embodiments as well as the accompanying drawings, wherein.

Figure 1:
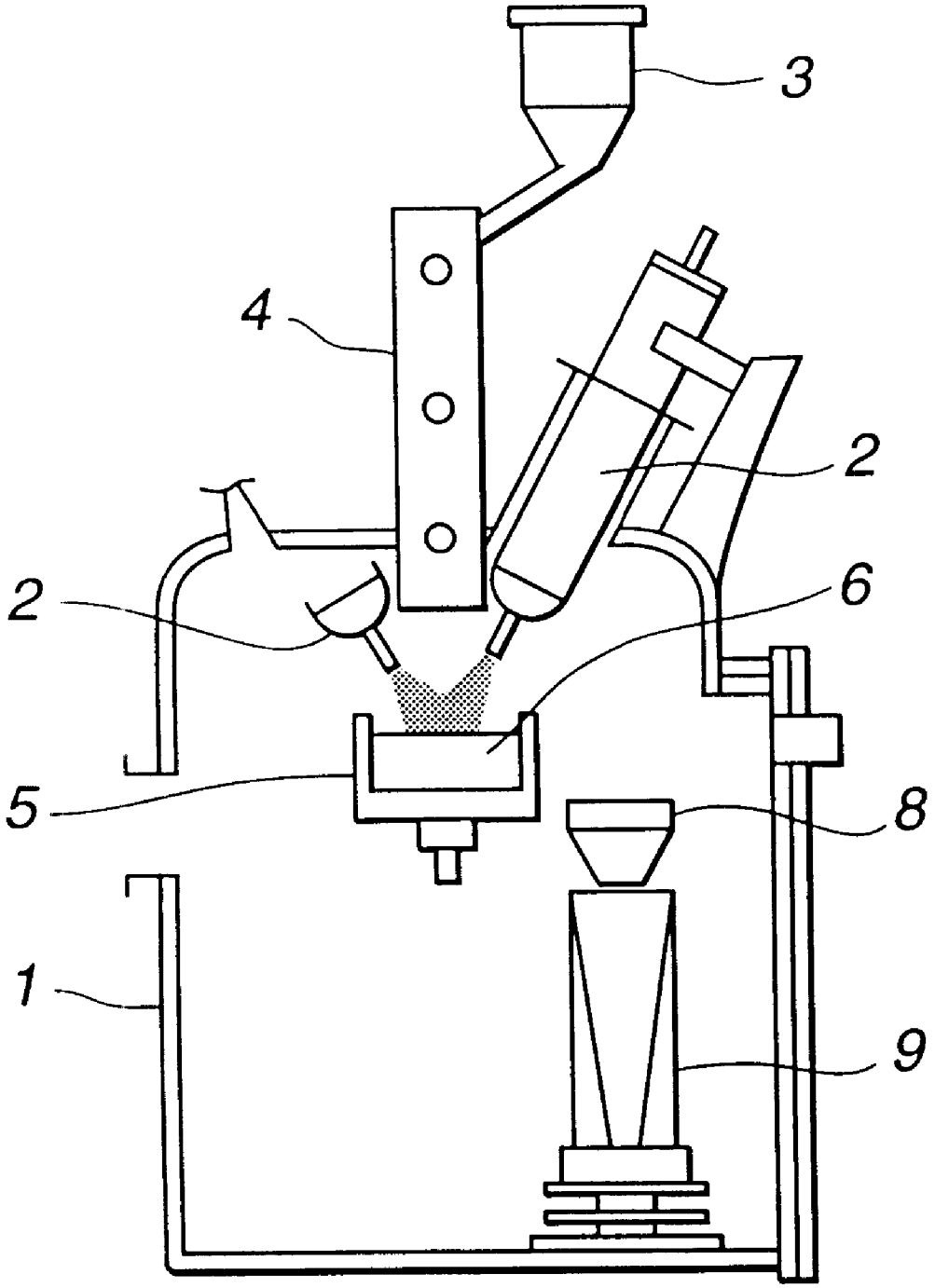
FIG. 1 is a schematic view showing an exemplary plasma melting furnace.

It should be understood that the drawings are not necessarily to scale and that the embodiments are sometimes illustrated by graphic symbols, phantom lines, diagrammatic representations and fragmentary views. In certain instances, details which are not necessary for an understanding of the invention or which render other details difficult to perceive may have been omitted. It should be understood, of course, that the invention is not necessarily limited to the particular embodiments illustrated herein.

DESCRIPTION OF THE PREFERRED EMBODIMENTS

Referring to the drawings, a method for refining and purification according to the present invention will be explained in detail.

In metals, such as Fe, Co, Ni or Cu, there are contained trace amounts of impurities of alkali metals, such as Na, impurities of alkaline earth metals, such as Ca or Mg, light elements, such as B, C, N, O, F, Al, Si, P, S or Cl, and radioactive elements, such as U or Th. Of these, light metal impurities, such as oxygen, nitrogen or carbon, raise significant problems in connection with removal thereof.

According to the present invention, the metals such as Fe, Co, Ni or Cu, are molten in an argon-hydrogen plasma arc containing active hydrogen H to evaporate and remove the impurities. This removal method is hereinafter termed a hydrogen plasma arc melting method. By this method, it becomes possible to effectively remove non-metal impurities, such as oxygen, nitrogen or carbon, to purify the metals and to recover high purity metals containing these impurities at an extremely low concentration level.

In the hydrogen plasma arc melting method, a hydrogen-contained gas is used as a plasma generating gas. This gas is a mixture of a hydrogen gas and an inert gas or is composed only of the hydrogen gas.

In the former case, the inert gas is an argon or nitrogen, argon gas is used as usual.

The proportion of the hydrogen gas in the plasma generating gas is preferably 0.05 to 100 vol. %. It is noted that the proportion of the hydrogen gas of 100% indicates that the plasma generating gas is composed entirely of hydrogen gas. If the proportion of the hydrogen gas is less than 0.05 vol. %, the effect of removing impurities, mainly oxygen, by addition, cannot be achieved satisfactorily.

In the above-described hydrogen plasma arc melting method, the pressure in the furnace is desirably adjusted to 1.33 kPa to 310 kPa (10 Torr to 2.3 kTorr). If the pressure in the furnace is outside this range, the plasma arc becomes unstable.

By the above method, trace amount of impurities contained in metals, such as Fe, Co, Ni or Cu, may be removed to improve the purity. This technique can be applied to purification of metals containing a large quantity of impurities, such as metal scraps.

Specifically, the metal scraps, containing a large quantity of impurities, can be processed by the above-described hydrogen plasma arc melting method to control the purity to 99.9%, especially to 1 to 50 mass-ppm in the case of oxygen, carbon and nitrogen. For controlling the concentration of impurities, it suffices to control e.g., the time of melting. For example, the impurities can be removed to a level not larger than 1 mass-ppm, depending on requirements.

The above-described basic purification method according to the present invention can, for example, be applied to a case in which ceramics inclusions are contained as impurities.

In this case, metals containing the ceramics inclusions are molten in an argon-hydrogen plasma arc containing active hydrogen H. This permits the ceramics inclusions to be floated over the molten metal due to difference of density between the molten metal and the ceramics inclusions. These floated ceramics inclusions are quickly decomposed and removed by the hydrogen plasma arc.

The above method can be applied to refining the metals. For example, oxygen can be promptly removed by melting metal oxides, such as $Fe_2O_3$, $Co_3O_4$, NiO or CuO, in an argon-hydrogen plasma arc containing active hydrogen H for reducing the impurity containing metal to metal.

In this case, the operating conditions, such as the proportion of hydrogen in the plasma generating gas, may be set as in the above-described refining method.

The mechanism for removing impurities by the above-described hydrogen plasma arc melting method is hereinafter explained.

In general, hydrogen is dissociated at an elevated temperature exceeding 5000 K as indicated by the following equation (1):

$$H_2 \rightarrow H + H \tag{1}$$

so that it exists as active hydrogen H.

This active hydrogen is markedly superior to the standard state hydrogen $H_2$ in reactivity and in the reducing power, so that, by utilizing this active hydrogen, the purification effect can be improved. That is, the vapor of metal impurities are reacted in the gas side boundary layer on the surface of the molten metal contacted with the hydrogen plasma phase as indicated by the following equation (2):

$$xM\ [\text{vapor}] + yH\ [\text{active hydrogen}] \rightarrow M_xH_y\ [\text{transient loose bond}] \tag{2}$$

where M is the vapor of alkali metal impurities, such as Na, impurities of alkaline earth metals, such as Ca, or of impurities of radioactive elements, such as U or Th, on the surface of the molten metal. Thus, the vapor of metal impurities having a vapor pressure higher than that of the metals, such as Fe, Co, Ni or Cu, forms a transiently loose bond with the active hydrogen H, the latter transports the vapor of impurities towards the gas phase side in a complementary fashion. The result is the promoted removal on evaporation of the metal impurities having a high vapor pressure.

As for the non-metallic impurities, such as oxygen, nitrogen or carbon, it may be presupposed that the reaction of the equation (3):

$$O\ (\text{in molten metal}) + H\ (\text{in plasma arc}) \rightarrow H_2O \tag{3}$$

is taking place for the case of oxygen.

As for these non-metallic impurities, oxygen yields water ($H_2O$) as indicated by the equation (3), whilst nitrogen and carbon yield nitrogen hydroxides (NHx) and hydrocarbon gases (CHx), such as methane or ethane. These compounds represent a stronger bond than the vapor of metal impurities so that the non-metallic impurities are migrated from the molten metal into the gas phase to promote purification of the molten metal. As a matter of course, this enables removal of the superficial oxide layer (film) of the molten metal to facilitate evaporation of metal impurities.

Thus, if the above process is viewed comprehensively, the removal mechanisms of the respective elements act organically in unison to display more prominent purification effect.

EXAMPLE 1

Based on experimental results, specified Examples of the present invention are explained.

In Co (cobalt), yielded as a scrap from a given process, an extremely large quantity (approximately 3000 mass-ppm) of oxygen is contained.

If this is molten in an argon-hydrogen plasma arc containing active hydrogen H, oxygen is removed as the melting time elapses.

In the present experiment, a plasma SKULL melting furnace, manufactured by DAIDO TOKUSHUKOU CO., LTD. (DAIDO STEEL CO. LTD.), shown in FIG. 1, was used. As for the test melting conditions, the amount of addition of $H_2$ was 5 vol. % at the maximum, the generating power was 300 kW and the mass of molten metal (Co) was 20 kg.

The plasma SKULL melting furnace was comprised of a furnace 1 on an upper portion and on the top of which were arranged a plasma torch 2 and a hopper 3, respectively. The starting material supplied from the hopper 3 was supplied via a starting material supplying tube 4 to a crucible 5 so as to be molten by the plasma arc emitted from the plasma torch 2.

The molten product 6 was freed of impurities and poured from a gate 8 into a casting mold 9 for molding to a pre-set shape.

The relation between the time of melting and the oxygen concentration is shown in Table 1:

TABLE 1

| time of addition and dissolution of hydrogen | oxygen concentration/ppm |
|---|---|
| 0 | 3000 |
| 30 minutes | 70 |
| 60 minutes | 30 |
| 90 minutes | 10 |

The present test, representing an example of execution on a melting furnace with a batch of 20 kg, indicates that, if a similar test is conducted in a button melting furnace of 10 g per batch, the time for deoxidation becomes shortest. The reason is possibly that the plasma arc can be applied to a wider area of the molten sample in the button melting furnace than in the plasma SKULL melting furnace so that the active hydrogen H can be projected on the substantially entire surface of the molten sample. That is, the test results indicate that, if the arc is applied ingenuously to the molten sample, the necessary melting time for deoxidation can be shorter.

Up to now, metal impurities contained in metals marketed as high purity metals are lowered to an extremely small value. However, impurities such as oxygen, nitrogen or carbon are contained in larger quantities than the metal impurities.

The present technique is the process whereby oxygen, nitrogen or carbon, in particular, can be removed more satisfactorily than with the conventional technique. If this technique is used, the melting time of approximately one hour and a half is sufficient for reducing the oxygen content of Co used for an evaporated tape to a permissible oxygen content of 10 mass-ppm, whilst a melting time of approximately three hours is sufficient for further reducing the content of oxygen, nitrogen or carbon to not higher than 1 mass-ppm.

EXAMPLE 2

In the present Example, the deoxidation test for Ni was conducted in a manner similar to Example 1. The test device used was a button melting furnace, with the maximum mass weight of melting being tens of g/batch, and with the maximum output being 10 kW.

Figure 2:
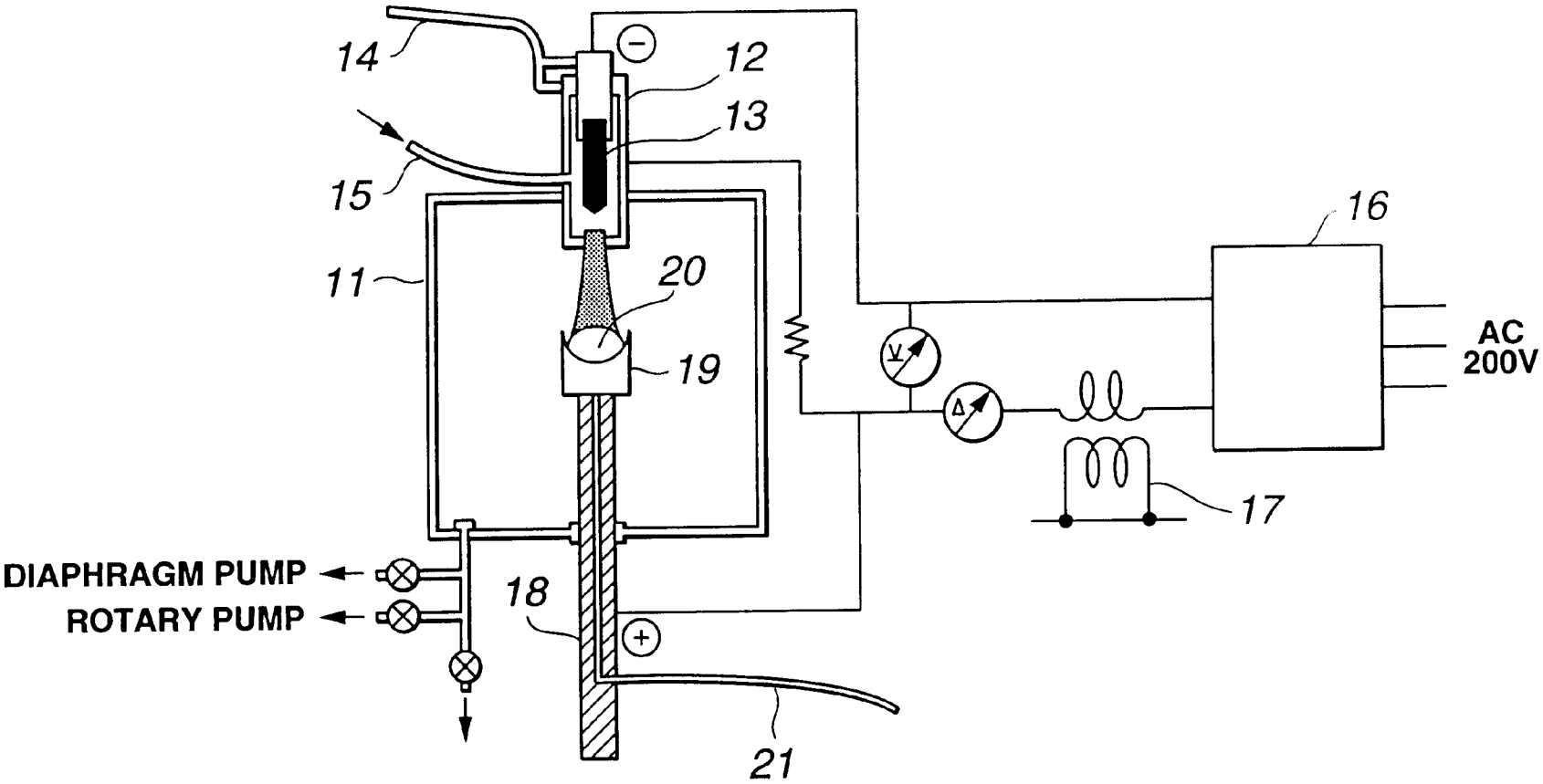
FIG. 2 is a schematic view showing an exemplary button melting furnace.

FIG. 2 shows the schematic structure of the button melting furnace used. This button melting furnace includes a plasma torch 12 arranged on the top of the furnace 11.

The plasma torch 12 includes a tungsten cathode 13 from the distal end of which a plasma arc is generated.

The plasma torch 12 is cooled by the cooling water circulated in a cooling tube 14 and is fed with a plasma generating gas, such as $Ar+H_2$, by a gas supply tube 15.

To the tungsten cathode 13 of the plasma torch 12 is connected a power source 16 via an RF starter 17 so that a minus potential is applied thereto.

At a position facing the tungsten cathode 13 is arranged a crucible 19 supported by a holder 18. It is metal 20 held therein that is molten by the plasma arc.

Meanwhile, the holder 18 is similarly cooled by the cooling water circulated through the cooling tube 21. The power source signals 16 applies a plus voltage to the holder 18.

The deoxidation efficiency of Ni by the hydrogen plasma arc melting method is higher than that of Co, such that melting for only 30 seconds at the hydrogen concentration of the order of 0.1 vol. % leads to deoxidation to 1 mass-ppm or less.

EXAMPLE 3

The present Example is directed to Co refining.

That is, $Co_3O_4$ was reduced in the present Example. The apparatus used was the same as that used in Example 2.

Powdered $Co_3O_4$ were molded to form pellets which then were set on a copper crucible. With a molding chamber closed, the inside thereof was evacuated to $10^{-2}$Torr. At this time, the inner atmosphere was replaced by Ar to sufficiently remove gas components adsorbed to the inner wall.

After the end of evacuation, the inner space of the chamber was charged with an Ar gas, and an Ar plasma was produced first to melt $Co_3O_4$ with the heat evolved at this time. After the entire mass was molten, a $H_2$ gas was started to be added. The $H_2$ gas was added only slowly because abrupt addition of the $H_2$ gas leads to abruptly increased impedance across the torch and the crucible and to extinguished plasma.

After the start of $H_2$ gas addition, the surface of the molten mass gradually begins to manifest metal luster. At an initial stage of the reaction, the surface tension of the molten oxide is small so that the molten mass is thrust by the wind pressure of the Ar—$H_2$ plasma arc and thereby displaced towards the outer side of the crucible. As the molten mass begins to show metal luster, that is as the metal state is approached with progress in reduction, the surface tension is increased to present a rounded shape.

Finally, the molten mass becomes pure metal to give a button-shaped lump presenting metal luster.

EXAMPLE 4

The present Example is directed to refining of copper (Cu).

In general, copper termed OFC (oxygen-free copper) has a purity of approximately 4N (99.99%). Changes in impurities contained in OFC before and after argon-hydrogen plasma arc melting containing active hydrogen were checked. The hydrogen concentration and the melting time were set to 10 vol. % and to 1.8 ks (30 minutes), respectively. Table 2 shows the content of impurities in Cu before and after argon-hydrogen plasma arc melting containing active hydrogen.

TABLE 2

| elements | starting material | after melting |
|---|---|---|
| C | 1.86 | 0.4 |
| N | 22.8 | 0.2 |
| O | 0.27 | 0.19 |
| F | 0.01 | 0.01 |
| P | $0.01_1$ | $0.01_3$ |

TABLE 2-continued

| elements | starting material | after melting |
|---|---|---|
| S | 4.4 | 0.2 |
| Cl | 0.03 | <0.005 |
| Li | <0.002 | <0.001 |
| Na | 0.007 | <0.001 |
| Mg | 0.01 | <0.001 |
| Al | 1.97 | 1.3 |
| Si | 1.44 | 2.0 |
| K | 0.005 | <0.001 |
| Ca | 0.22 | 0.045 |
| To | 0.03 | 0.03 |
| V | 0.006 | 0.016 |
| Cr | 0.23 | 0.2 |
| Mn | 0.16 | 0.19 |
| Fe | 3.9 | 3.9 |
| Ni | 1.6 | 1.5 |
| Co | 0.1 | $0.1_2$ |
| Zn | $0.1_2$ | 0.15 |
| As | $0.4_0$ | 0.5 |
| Se | $0.0_8$ | $0.0_2$ |
| Zr | 0.1 | 0.01 |
| Nb | 0.08 | 0.01 |
| Mo | 0.2 | 0.08 |
| Ag | 5.4 | 5.3 |
| Cd | $0.02_7$ | $0.01_8$ |
| Sn | 2.4 | 0.9 |
| Sb | 0.3 | 0.4 |
| Te | 0.04 | <0.03 |
| Ta | 0.09 | 0.1 |
| W | 0.008 | 0.008 |
| Au | 0.01 | 0.002 |
| Hg | 0.02 | <0.01 |
| Pb | 0.3 | 0.01 |
| Bi | $0.00_5$ | <0.002 |
| Th | 0.03 | 0.0003 |
| U | 0.0003 | 0.0002 |

As may be seen from Table 2, carbon, nitrogen and oxygen could be removed efficiently. Also, alkali metals, such as Na, Mg, K or Ca, alkaline earth metals and radioactive elements, such as Th or U, have been removed.

EXAMPLE 5

In the present Example, removal of nitrogen in Fe was scrutinized.

Figure 3:
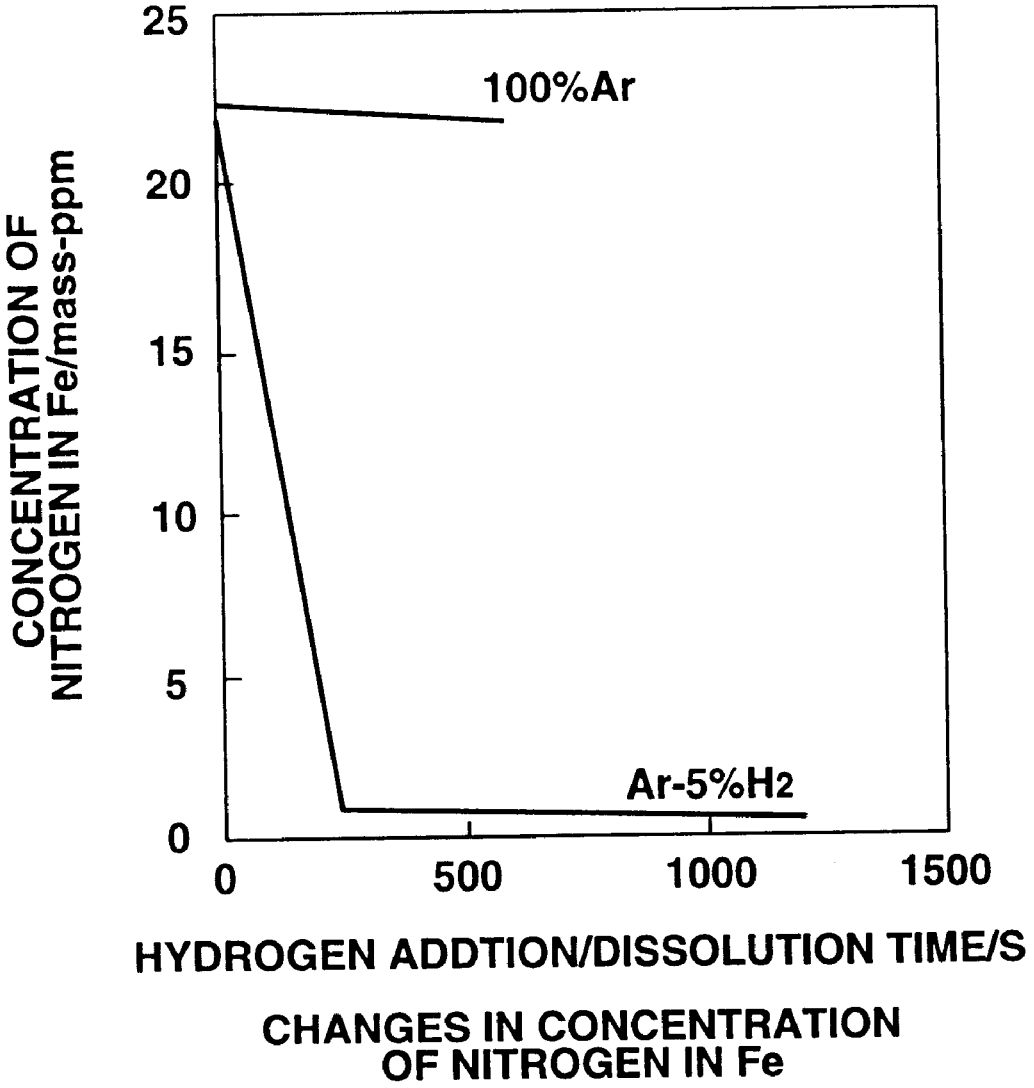
FIG. 3 illustrates, graphically, changes in the concentration of nitrogen in Fe.

That is, changes in nitrogen concentration in Fe at the time of argon-hydrogen plasma arc melting containing active hydrogen were checked. The results are shown in FIG. 3.

As shown therein, progress in denitration hardly occurs in Ar plasma arc melting, whereas, if 5 vol. % of hydrogen is added to this plasma gas, the nitrogen concentration in Fe could be reduced to 1 mass-ppm or less in a short time.

From the above description it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A method for purifying metals comprising:

melting at least one metal containing at least one impurity in a plasma arc generating gas comprising hydrogen or a mixture of hydrogen and an inert gas including argon wherein the hydrogen includes active hydrogen; wherein the hydrogen is present in an amount ranging from about 0.05 vol % to about 100 vol %; wherein the metal comprises at least one metal selected from the group consisting of Fe, Co, Ni and Cu; and wherein the impurities comprise at least one selected from the group consisting of alkali metal impurities, alkaline earth metal impurities, radioactive element impurities and non-metallic impurities including at least one of oxygen nitrogen carbon.

2. The purification method of claim 1 wherein the melting step is conducted in a furnace having a pressure ranging from about 1.33 kPa to about 310 kPa.

3. A method for refining metals comprising:

melting at least one metal comprising at least one ceramic in a plasma arc generating gas comprising hydrogen including active hydrogen.

4. The metal refining method of claim 3 wherein the metal comprises at least one metal selected from the group consisting of Fe, Co, Ni and Cu.

5. The metal refining method of claim 3 wherein the hydrogen is present in the plasma arc generating gas in an amount ranging from about 0.05 vol % to about 100 vol %.

6. The metal refining method of claim 3 wherein the melting, floating and decomposing and removing steps are carried out in a furnace having a pressure ranging from about 1.33 kPa to about 310 kPa.

7. The method of claim 3 wherein the plasma arc generating gas further comprises an inert gas including argon.

8. A method for refining metals comprising:

melting at least one metal oxide in a plasma arc generating gas comprising hydrogen including active hydrogen for reducing the at least one metal oxide to a metal.

9. The metal refining method of claim 8 wherein the metal comprises at least one metal selected from the group consisting of Fe, Co, Ni and Cu.

10. The metal refining method of claim 8 wherein the hydrogen is present in the plasma arc generating gas in an amount ranging from about 0.05 vol % to about 100 vol %.

11. The metal refining method of claim 8 wherein the melting step is carried out in a furnace having a pressure ranging from about 1.33 kPa to about 310 kPa.

12. The method of claim 8 wherein the plasma arc generating gas further comprises an inert gas including argon.

* * * * *